US009802237B2

(12) United States Patent
Moncho

(10) Patent No.: US 9,802,237 B2
(45) Date of Patent: Oct. 31, 2017

(54) HEAD OF AN EXPLODING-WIRE ELECTROHYDRAULIC DISCHARGE DEVICE

(71) Applicant: ADM28 s.àr.l., Luxembourg (LU)

(72) Inventor: Salvador Moncho, Malakoff (FR)

(73) Assignee: ADM28 s.ár.l., Luxembourg (LU)

( * ) Notice: Subject to any disclaimer, the term of this patent is extended or adjusted under 35 U.S.C. 154(b) by 367 days.

(21) Appl. No.: 14/382,112

(22) PCT Filed: Feb. 22, 2013

(86) PCT No.: PCT/EP2013/053582
§ 371 (c)(1),
(2) Date: Aug. 29, 2014

(87) PCT Pub. No.: WO2013/127706
PCT Pub. Date: Sep. 6, 2013

(65) Prior Publication Data

US 2015/0033815 A1 Feb. 5, 2015

(30) Foreign Application Priority Data

Feb. 29, 2012 (FR) ..... 12 51873

(51) Int. Cl.

| | |
|---|---|
| ***B21D 26/12*** | (2006.01) |
| ***B21D 26/10*** | (2006.01) |
| ***F42B 3/04*** | (2006.01) |
| ***F42D 3/00*** | (2006.01) |

(52) U.S. Cl.
CPC ..... *B21D 26/12* (2013.01); *B21D 26/10* (2013.01); *F42B 3/04* (2013.01); *F42D 3/00* (2013.01)

(58) Field of Classification Search
CPC ..... B21D 26/06; B21D 26/10; B21D 26/12; B21D 26/08
USPC ..... 72/706
See application file for complete search history.

(56) References Cited

U.S. PATENT DOCUMENTS

| | | | | |
|---|---|---|---|---|
| 3,559,435 | A * | 2/1971 | Gerber | B21D 26/12 102/202.8 |
| 3,603,127 | A | 9/1971 | Seiffert et al. | |
| 3,852,985 | A * | 12/1974 | Haeusler | B21D 26/10 72/56 |
| 3,863,327 | A | 2/1975 | Legate et al. | |
| 4,635,840 | A | 1/1987 | Cenanovic | |
| 6,591,649 | B1 * | 7/2003 | Gafri | B21D 26/12 29/421.1 |
| 7,493,787 | B2 | 2/2009 | Golovashchenko et al. | |
| 7,802,457 | B2 * | 9/2010 | Golovashchenko | B21D 26/00 29/419.2 |
| 2003/0075068 | A1 | 4/2003 | Kim | |

(Continued)

FOREIGN PATENT DOCUMENTS

| | | |
|---|---|---|
| EP | 0 043 672 A2 | 1/1982 |
| FR | 2 003 162 A1 | 11/1969 |

(Continued)

*Primary Examiner* — Debra Sullivan
(74) *Attorney, Agent, or Firm* — Seed IP Law Group LLP

(57) ABSTRACT

A head of an electrohydraulic discharge device of the invention comprises: —an end of a power cable having a first conductor and a second conductor, —an explosive wire comprising multiple segments assembled in a series, and —means for connecting each of the ends of the explosive wire to the end of the power cable.

6 Claims, 2 Drawing Sheets

(56) References Cited

U.S. PATENT DOCUMENTS

Figure 1:
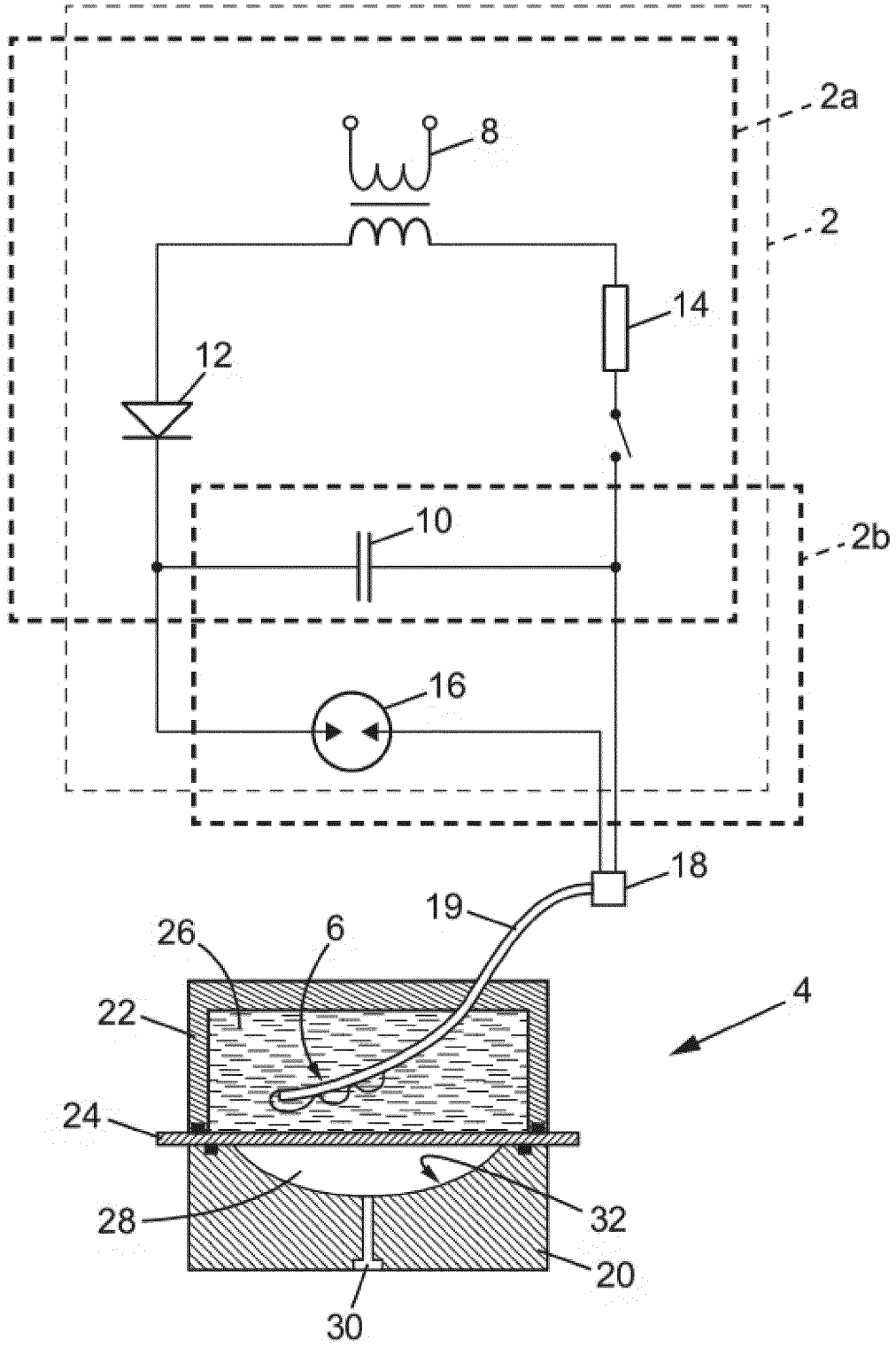

| | | | |
|---|---|---|---|
| 2009/0272167 | A1 | 11/2009 | Golovashchenko |
| 2011/0067470 | A1 | 3/2011 | Golovashchenko et al. |
| 2011/0088442 | A1 | 4/2011 | Golovashchenko |

FOREIGN PATENT DOCUMENTS

| | | | |
|---|---|---|---|
| FR | 2 563 126 | A1 | 10/1985 |
| GB | 1129562 | A | 10/1968 |
| JP | 7-155868 | A | 6/1995 |
| JP | 2006-142338 | A | 6/2006 |
| JP | 2009-145000 | A | 7/2009 |
| KR | 10-2008-0075685 | A | 8/2008 |
| WO | 2008/037949 | A1 | 4/2008 |

* cited by examiner

HEAD OF AN EXPLODING-WIRE ELECTROHYDRAULIC DISCHARGE DEVICE

The invention relates to a head of an exploding-wire electrohydraulic discharge device.

It is known to use the pressure of a fluid to achieve plastic deformation of a sheet held in a mold. The fluid, preferably liquid, then acts on the sheet and forces it to assume the shape of the mold. Such a method is called hydroforming and is used as a manufacturing method, particularly for parts that have complex shapes.

The fluid (liquid) can be pressurized in various ways. The present invention concerns the case where a strong electrical discharge is used to energize the liquid and bring it to very high pressures, particularly in the case where said electrical discharge travels through a wire placed between two electrodes. When said wire is traversed by a very intense current, it explodes and generates a plasma, creating a pressure wave in the liquid in which it is immersed. The invention particularly concerns the forming of sheets but also of other workpieces made of a plastically deformable material.

Conventionally, the electrical energy is accumulated in a capacitor of known capacitance. It is first charged to a predetermined voltage. A power cable connects the capacitor, via switching means, to the two ends of the metal wire of predetermined length and diameter. A rapid discharge of the capacitor across this wire is then initiated in order to explode the wire and thus create the pressure wave and form the part. The end of the power cable, for example a coaxial cable, forms the two electrodes connected by the wire. The assembly formed by the end of the power cable, the wire, and the connection of the wire to the power cable will be called the tool head in the following description.

Document FR-2 003 162, for example, describes using a method of electro-hydroforming by exploding wire to form a tube. A wire, called a "fil d'amorçage" or trigger wire in this document, is arranged inside a tube to be formed and is immersed in water. This document teaches limiting the diameter of the trigger wire so that it measures no more than 0.02 mm.

The use of an exploding wire in a liquid medium, known as electrohydraulic discharge, is also applicable to other industries. One example is the mining industry, for crushing ore, cracking rocks, separating inclusions, and generally for breaking apart bonds in materials.

The aim of the invention is to further optimize the wire used for such methods, and therefore provide an electrohydraulic discharge tool head which allows better control of the shock wave distribution in the liquid. Advantageously, a tool head of the invention will allow better placement of the electrohydraulic pressure where it is needed. It will allow, for example, creating a greater local pressure for deforming a sheet (or other workpiece) with a low local radius of curvature, or distributing the pressure more uniformly on the part to be deformed while having the discharge close to said workpiece. Preferably, the pressure created by the tool head of the invention will be maximized so as to increase the yield from the electrohydraulic discharge tool.

For this purpose, the invention proposes an electrohydraulic discharge tool head comprising a power cable end having a first conductor and a second conductor, an explosive wire, and means for connecting each of the ends of the explosive wire to the end of the power cable.

In the invention, the explosive wire comprises several segments assembled in a series.

Surprisingly, the fact of having multiple wire segments assembled in a series allows having an explosion for each segment. It is therefore possible to better control the position of the explosions and hence distribute the shock waves within the fluid in which the wire is immersed.

To have a more uniform distribution of the shock wave, it is proposed for example that the explosive wire comprise at least three segments.

One embodiment of a tool head of the invention provides for said head having a central electrode arranged at the center of a tubular part of insulating material, said central electrode having, on the one hand, a proximal end connected to the first conductor of the power cable and, on the other hand, a distal end connected to an end of the explosive wire, the other end of the explosive wire being connected by the connecting means to the second conductor of the power cable. This embodiment offers the advantage of having a low cost price.

In a first variant embodiment of the invention, each segment is connected to a neighboring segment by a connector, referred to as the intermediate electrode. In the case where the tool head has a tubular part of insulating material at its distal end, then each intermediate electrode can be, for example, attached to the outer periphery of the tubular part of insulating material.

In a second (preferred) variant embodiment of a tool head of the invention, the explosive wire is for example made of a single piece, the segments being created by locally attaching the explosive wire to a support using attachment means made of an electrically conductive material. This embodiment is easier to implement because the number of connections (or connectors) is limited. In this second variant, when the tool head also has a tubular part of insulating material, it can then be arranged so that the explosive wire lies outside the tubular part of insulating material, and so that conductive rings locally retain the explosive wire on the outer surface of the tubular part of insulating material, thus creating wire segments between said rings. The conductive rings thus crimp for example the explosive wire onto the tubular part of insulating material. To limit the resistance of the conductive rings, they are made of copper for example.

In a tool head of the invention, the power cable can be a coaxial cable and/or a shielded cable.

The invention also relates to an electrohydraulic discharge tool comprising a tool head as described above.

Lastly, the invention also relates to an electro-hydroforming device comprising an electrohydraulic discharge tool as described above.

Figure 2:
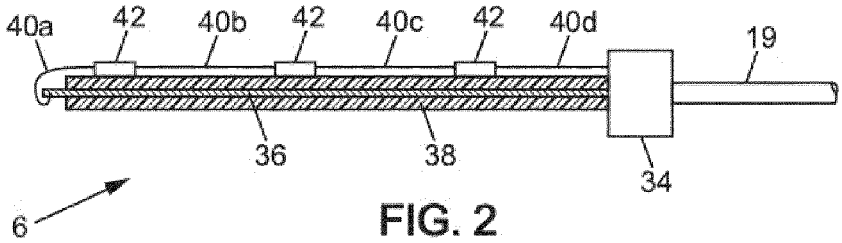
Figure 3:
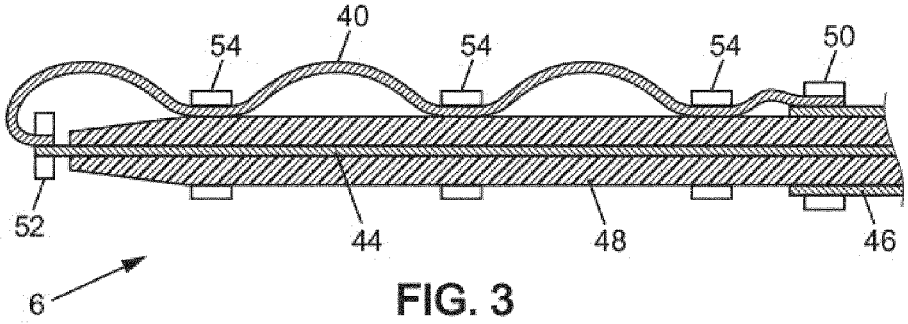

Features and advantages of the invention will be more apparent from the following description, with references to the attached drawing in which:

FIG. 1 schematically illustrates an electro-hydroforming tool according to the invention, FIG. 2 is an enlarged detailed view of a first electro-hydroforming tool head according to the invention, and FIG. 3 is a view of a second embodiment of a tool head according to the invention.

A person skilled in the art will recognize an exploding wire electro-hydroforming tool in FIG. 1. Such a tool conventionally comprises an electrical pulse generator 2 and a chamber 4 which is occupied by a tool head 6.

The pulse generator 2 illustrated in FIG. 1 is provided as a non-limiting example, and other types of electrical pulse generators can be used without leaving the scope of the invention. The pulse generator 2 represented comprises a high-voltage charging system 2*a* and a discharge circuit 2*b*.

The charging system 2*a* first comprises a transformer 8 in which a primary circuit is connected to the terminals of a voltage source (not represented in the drawing). Then the secondary circuit of the transformer 8 is used to charge one (or more) capacitor(s) 10 with the aid of a diode 12 and a charge switch 14. Only one capacitor 10 will be mentioned In the rest of the description, although there may be multiple capacitors as indicated above.

The discharge circuit 2*b* comprises the capacitor 10 as well as a discharge switch, also commonly referred to as a spark gap 16. A first connector 18 is arranged at the exit from the discharge circuit 2*b*, for connecting it to a power cable 19. This power cable 19 is a bundle of wires (or cables) that conducts electricity and supported by a sheath. In a preferred embodiment, it may be in the form of a coaxial cable comprising a conductive core and a peripheral conductor, therefore two conductors. One terminal of the capacitor 10 is connected to one of the conductors of the power cable 19 while the other terminal of the capacitor 10 is connected to the other conductor of the power cable 19 via the first connector 18.

The form and function of the various components of the pulse generator 2 cited here are known to a person skilled in the art, and are not further detailed in the present description.

The tool head 6 is assembled onto the distal end of the power cable 19 and is located inside the chamber 4. This chamber is made of two parts in the embodiment illustrated in FIG. 1 which is a schematic figure. Thus the chamber illustrated has a lower part (in the orientation in FIG. 1) referred to below as the die 20 and an upper part referred to below as the discharge frame 22. A workpiece 24 is hermetically arranged between the die 20 and the discharge frame 22, separating the inside of the chamber 4 into a discharge chamber 26 on the discharge frame 22 side, and a forming chamber 28 on the die 20 side.

The discharge chamber 26 is filled with an incompressible fluid, for example water, while the forming chamber 28 is preferably under vacuum. A channel 30 is created in the die 20 to connect the forming chamber 28 to a vacuum pump, not represented. However, as a variant or in the absence of a device for creating this vacuum, the air can be left in the forming chamber 28 and there can be vents (for example the channel 30) to allow the air to escape during forming.

Facing the workpiece, the die 20 presents a cavity 32 corresponding to the shape that the workpiece 24 is to have after deformation. The tool head 6 is plunged into the water located in the discharge chamber 26. When the capacitor 10 is discharged, a dynamic pressure wave is created and pushes the workpiece 24 against the cavity 32 in the die 20.

FIG. 2 illustrates a first embodiment of a tool head 6 according to the invention. One will recognize the distal end of the power cable 19 on the right side of this figure, which is present here in the form of a coaxial cable and which receives a second connector 34. Downstream from this connector, the tool head 6 presents a central core 36, an insulating sleeve 38, and an explosive wire.

Inside the second connector 34 are located two electrodes (not shown), each corresponding to a polarity of the pulse generator 2. Each electrode is connected to the corresponding polarity via either the conductive core or the peripheral conductor of the power cable 19.

The central core 36 is in the form of a cylindrical rod and is for example electrically connected at the second connector 34 to the polarity of the pulse generator 2 which corresponds to the conductive core of the power cable 19.

The insulating sleeve 38 is a cylindrical tubular part made of synthetic material which surrounds the central core 36 for substantially its entire length and insulates it electrically.

The explosive wire has a distal end which is connected, for example welded, to the distal end of the central core 36, and a distal end connected at the second connector 34 to the electrode corresponding for example to the polarity of the pulse generator 2 connected to the peripheral conductor of the power cable 19. This explosive wire is formed of several distinct segments 40*a* to *d*. A connector is located between each segment, referred to below as an intermediate electrode 42. Each intermediate electrode 42 ensures electrical continuity between the two segments that it connects. In the embodiment represented in the drawing, there are four wire segments (40*a*, 40*b*, 40*c* and 40*d*) connected to each other by three intermediate electrodes 42.

The intermediate electrodes 42 are attached to the outer surface of the insulating sleeve 38. Thus they both create an electrical connection and mechanically retain the corresponding segments.

In this embodiment, several segments (40*i*) are assembled in a series between two electrodes. Each wire segment forms a filament which is intended to be vaporized when significant current passes through it, releasing the energy necessary to vaporize part of the surrounding liquid (water in the preferred embodiment used here, but any non-explosive liquid or gel is suitable), thus causing an increase in pressure in the liquid that is sufficient to deform the workpiece 24 and cause it to assume the shape imposed by the cavity 32.

FIG. 3 illustrates another embodiment of the tool head 6. The same references as those used above are used again here to denote similar elements in the following description of this second embodiment.

In this embodiment, the explosive wire is denoted 40. It is mounted directly on the distal end of the power cable 19. Conventionally, and as was already mentioned above, the power cable 19 has a conductive core 44 that is insulated from a conductive sheath 46 by insulation 48. The conductive sheath 46 is also covered with an outer insulating envelope (not represented here because it is absent at the distal end being described).

The distal end of the power cable 19 is without its conductive sheath 46 for a length on the order of several tens of millimeters to several tens of centimeters. The outer insulating envelope is removed from the distal end for at least several millimeters before the end of the conductive sheath 46.

In this configuration of the distal end of the power cable 19, the explosive wire 40 is attached between the distal end of the conductive sheath 46 and the distal end of the conductive core 44. The electrical connection between the explosive wire 40 and the coaxial cable can be achieved in various ways, as long as there is a good electrical connection and a good mechanical connection. The solution proposed in FIG. 3 establishes a connection using a crimping ring at each point. A first crimping ring 50 maintains the proximal end of the explosive wire 40 on the distal end of the conductive sheath 46, while a second crimping ring 52 is used to attach and electrically connect the distal end of the conductive core 46 to the distal end of the explosive wire 40.

As one can see in FIG. 3, the explosive wire 40 is also retained on the insulation 48 by conductive rings 54. The explosive wire 40 is thus divided into segments, defined by the conductive rings 54, which act like the segments assembled in a series in the embodiment in FIG. 2. Each conductive ring 54, for example made of copper, acts as an electrical bridge. The conductive rings 54 can be crimped, for example, to guarantee good mechanical retention and a good electrical connection with the explosive wire 40.

Here again, the explosive wire 40 is intended to be vaporized in each of its segments, during the passage of a high intensity current, releasing the energy necessary to vaporize a portion of the surrounding fluid so as to create a local increase in pressure which is propagated as a shock wave and enables the deformation of the workpiece 24.

The characteristics of one embodiment can be combined with the characteristics of another embodiment described above. For example, one can have in the embodiments of FIGS. 2 and 3 an explosive wire in multiple segments without using a second connector, or have an explosive wire that is all one piece and is retained with conductive rings while a connection is established with a coaxial cable using a connector similar to the second connector 34 (or to a connector of another type).

For the two embodiments described, a few non-limiting examples of some dimensions are provided for illustrative purposes.

The filament used to create the explosive wire (or explosive segments) thus has for example a diameter of between 0.1 and 2.0 mm. It may be made of copper for example. The total length of the explosive wire is determined as a function of the energy to be dissipated and the voltage applied to the wire terminals. For example, for an energy to be dissipated of between $10^2$ and $10^6$ Joules, the total length of the explosive wire—meaning the cumulative length of all the wire segments—will be on the order of 2 to 50 cm. A length can be provided (this is purely illustrative) of about a centimeter (between 0.1 and 2.5 cm) for each kV applied. For example, one thus has an explosive wire of 10 cm for an applied voltage of 10 kV. This wire can be, for example, in the form of two segments of 5 cm or in the form of four segments of 2.5 cm (or n segments of 10/n cm).

The invention therefore proposes having several segments of explosive wire assembled in a series. When a current travels through the explosive wire, each segment is made to explode. Due to the distribution into segments, it is thus possible to better control the distribution of the energy released. In the electro-hydroforming method, or in another method making use of an electrohydraulic discharge, the electrohydraulic pressure is better controlled. It is possible to localize an explosion of a segment to the vicinity of an area of the workpiece having, for example, a small radius of curvature, or to distribute the electrohydraulic pressure as uniformly as possible across all of the workpiece.

The embodiments proposed here offer the advantage of no significant increase in cost compared to existing solutions that make use of an exploding wire.

The invention is not limited to the preferred embodiments described above as non-limiting examples nor to the variants mentioned. It also relates to variants evident to a person skilled in the art within the context of the following claims.

The invention claimed is:

1. An electrohydraulic discharge tool head comprising:

an end of a power cable having a first conductor and a second conductor;

a conductive explosive wire;

means for connecting ends of the explosive wire to the end of the power cable, wherein the explosive wire comprises plural segments electrically connected to each other in a series;

a support; and at least one retaining member made of an electrically conductive material, wherein the explosive wire is made of a single piece, the segments being created by locally attaching the explosive wire to the support using the at least one retaining member.

2. The tool head according to claim 1, wherein the explosive wire comprises at least three segments.

3. The tool head according to claim 1, wherein the support includes a tubular part of insulating material, the tool further comprising:

a central electrode arranged at a center of the tubular part of insulating material, wherein said central electrode has a proximal end connected to the first conductor of the power cable and a distal end connected to a first end of the explosive wire, and wherein a second end of the explosive wire is connected by the connector to the second conductor of the power cable, wherein the explosive wire lies outside the tubular part of insulating material, and wherein the at least one retaining member includes conductive rings that locally retain the explosive wire on an outer surface of the tubular part of insulating material, thus creating wire segments between said rings.

4. The tool head according to claim 1, wherein the power cable is a coaxial cable.

5. An electrohydraulic discharge tool comprising a tool head according to claim 1.

6. An electro-hydroforming device comprising an electrohydraulic discharge tool according to claim 5.

* * * * *